US010364111B2

(12) United States Patent
Wu et al.

(10) Patent No.: US 10,364,111 B2
(45) Date of Patent: Jul. 30, 2019

(54) PAPER WARPING DETECTION DEVICE AND PAPER WARPING DETECTION METHOD APPLIED THEREIN

(71) Applicant: Foxlink Image Technology Co., Ltd., New Taipei (TW)

(72) Inventors: Ming Da Wu, New Taipei (TW); Shih Sen Huang, New Taipei (TW); Chang Yuan Wu, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 16/122,931

(22) Filed: Sep. 6, 2018

(65) Prior Publication Data

US 2019/0100395 A1 Apr. 4, 2019

(30) Foreign Application Priority Data

Oct. 3, 2017 (TW) ..... 106134205 A

(51) Int. Cl.
*B65H 7/06* (2006.01)
*B65H 3/06* (2006.01)
*B65H 7/20* (2006.01)

(52) U.S. Cl.
CPC ..... *B65H 7/06* (2013.01); *B65H 3/06* (2013.01); *B65H 7/20* (2013.01); *B65H 2511/17* (2013.01); *B65H 2515/82* (2013.01); *B65H 2553/30* (2013.01); *B65H 2553/822* (2013.01); *B65H 2557/31* (2013.01)

(58) Field of Classification Search
CPC ... B65H 7/06; B65H 9/20; B65H 7/00; B65H 7/20
See application file for complete search history.

(56) References Cited

U.S. PATENT DOCUMENTS 8,201,823 B2 * 6/2012 Morikawa ..... B65H 3/5261 271/10.01
8,636,282 B2 * 1/2014 Oshiro ..... B65H 1/266 271/145
2016/0185544 A1 * 6/2016 Link ..... B65H 43/04 271/265.02
2017/0359475 A1 * 12/2017 Xie ..... G03G 15/55
2018/0215564 A1 * 8/2018 Matsumura ..... B65H 7/06

* cited by examiner

*Primary Examiner* — Howard J Sanders
(74) *Attorney, Agent, or Firm* — Lin & Associates Intellectual Property, Inc.

(57) ABSTRACT

A paper warping detection device includes an input tray, a processor, a first emitting element, a first receiving element and a first analog-to-digital converter. A first critical value is stored in the processor. The first emitting element is electrically connected with the processor. The first receiving element is disposed to the other side of the input tray. The first receiving element and the first emitting element face each other. When the first emitting element is switched on, the first emitting element emits first ultrasonic wave signals towards the first receiving element. The first analog-to-digital converter is electrically connected with the first receiving element and the processor for converting the first ultrasonic wave signals into first digital signals and outputting the first digital signals to the processor. The processor reads the first digital signals and compares the first digital signals with the first critical value.

18 Claims, 7 Drawing Sheets

PAPER WARPING DETECTION DEVICE AND PAPER WARPING DETECTION METHOD APPLIED THEREIN

CROSS-REFERENCE TO RELATED APPLICATION

The present application is based on, and claims priority from, Taiwan Patent Application No. 106134205, filed Oct. 3, 2017, the disclosure of which is hereby incorporated by reference herein in its entirety.

BACKGROUND OF THE INVENTION

1. Field of the Invention

The present invention generally relates to a detection device and a detection method applied therein, and more particularly to a paper warping detection device capable of effectively detecting whether a plurality of pieces of paper are warped or not at the time of an uppermost piece of the paper being fed in, and a paper warping detection method applied in the paper warping detection device.

2. The Related Art

A conventional transaction device which is a printer or a scanner etc, is applied to print or scan. The conventional transaction device includes a pickup roller, and an input tray for loading a plurality of pieces of paper thereon. When the pickup roller picks up an uppermost piece of the paper in a process of the conventional transaction device printing or scanning, a leading end of the uppermost piece of the paper is apt to incur a warping deformation if a specialized device is not equipped on the conventional transaction device. The specialized device prevents the uppermost piece of the paper from being damaged. However, when the leading end of the uppermost piece of the paper incurs the warping deformation, the pickup roller will still drive the uppermost piece of the paper to be fed in and damage the uppermost piece of the paper. Specifically when the leading end of the uppermost piece of the paper which is fed in and the leading ends of the other pieces of the paper which are to be fed in located under the uppermost piece of the paper are stapled, and the pickup roller is driven to pick up the uppermost piece of the paper and feed the uppermost piece of the paper in, the leading end of the uppermost piece of the paper will incur the warping deformation, and the pickup roller will still drive the uppermost piece of the paper to be fed in and damage the uppermost piece of the paper. In addition, when a tail end of the uppermost piece of the paper which is fed in and the tail ends of the other pieces of the paper which are to be fed in and located under the uppermost piece of the paper are stapled, and the pickup roller picks up the uppermost piece of the paper and drives the uppermost piece of the paper to be fed in, the tail end of the uppermost piece of the paper will bring along the tail ends of the other pieces of the paper which are stapled with the uppermost piece of the paper to warp together, and if the uppermost piece of the paper continues being fed in, the plurality of pieces of the paper will be damaged as well.

Thus, it is essential to provide a paper warping detection device and a paper warping detection method applied in the paper warping detection device, the paper warping detection device is applied in a transaction device, and the paper warping detection device applying the paper warping detection method is capable of effectively detecting whether a plurality of pieces of paper are warped or not at the time when an uppermost piece of the paper is fed in, so that the plurality of pieces of the paper are prevented from being damaged at the time of the uppermost piece of the paper being fed in.

SUMMARY OF THE INVENTION

An object of the present invention is to provide a paper warping detection device. The paper warping detection device includes an input tray for loading a plurality of pieces of paper to be fed, a processor, a first emitting element, a first receiving element a first analog-to-digital converter, a second emitting element, a second receiving element and a second analog-to-digital converter. A first critical value is stored in the processor. The first emitting element is disposed to one side of the input tray. The first emitting element is electrically connected with the processor. The processor controls the first emitting element to be switched on or switched off. The first receiving element is disposed to the other side of the input tray. The first receiving element and the first emitting element face each other. When the first emitting element is switched on, the first emitting element emits first ultrasonic wave signals towards the first receiving element. So the first receiving element receives the first ultrasonic wave signals emitted by the first emitting element. The first analog-to-digital converter is electrically connected with the first receiving element and is electrically connected with the processor for converting the first ultrasonic wave signals received by the first receiving element into first digital signals and outputting the first digital signals to the processor. The processor reads the first digital signals outputted by the first analog-to-digital converter and compares the first digital signals with the first critical value. The second emitting element is located above a front end of the input tray and is electrically connected with the processor. The processor controls the second emitting element to be switched on or switched off. When the second emitting element is switched on, the second emitting element emits second ultrasonic wave signals frontward and downward towards a top surface of an uppermost piece of the paper. The second receiving element is located above the front end of the input tray for receiving the second ultrasonic wave signals emitted by the second emitting element and reflected by the uppermost piece of the paper. The second analog-to-digital converter is electrically connected with the second receiving element and is electrically connected with the processor for converting the second ultrasonic wave signals reflected by the uppermost piece of the paper into second digital signals and outputting the second digital signals to the processor. The processor reads the second digital signals outputted by the second analog-to-digital converter and compares the second digital signals with a second critical value stored in the processor.

Another object of the present invention is to provide a paper warping detection method applied in a paper warping detection device. Specific steps of the paper warping detection method are described hereinafter. Emit first ultrasonic wave signals by using a first emitting element, and the first ultrasonic wave signals are across a leading end of a top surface of an uppermost piece of paper. Receive the first ultrasonic wave signals by using a first receiving element facing the first emitting element. Convert the first ultrasonic wave signals into first digital signals by using a first analog-to-digital converter. The first digital signals are outputted to a processor by the first analog-to-digital converter. Store a first critical value in the processor. Read the first digital signals and compare the first digital signals with the first critical value by using the processor. When a strength of the first digital signals outputted by the first analog-to-digital converter is less than the first critical value, the paper is judged to be warped at the time of the uppermost piece of the paper being fed in. Otherwise, the paper is judged to be normally fed at the time of the uppermost piece of the paper being fed in. Emit second ultrasonic wave signals frontward and downward towards the top surface of the uppermost piece of the paper by using a second emitting element, the second ultrasonic wave signals are reflected by the uppermost piece of the paper. Receive the reflected second ultrasonic wave signals by using a second receiving element. Convert the reflected second ultrasonic wave signals into second digital signals by using a second analog-to-digital converter. The second digital signals are outputted to a processor by the second analog-to-digital converter. Store a second critical value in the processor, read the second digital signals and compare the second digital signals with the second critical value by using the processor. When a strength of the second digital signals is greater than the second critical value, the uppermost piece of the paper is judged to be warped at the time of the uppermost piece of the paper being fed in, and the plurality of pieces of the paper are stopped. Otherwise, the uppermost piece of the paper is judged to be normally fed at the time of the uppermost piece of the paper being fed in.

Another object of the present invention is to provide a paper warping detection device assembled in a transaction device. The paper warping detection device includes an input tray for loading a plurality of pieces of paper, a first emitting element disposed to one lateral side of the input tray, a first receiving element disposed to the other lateral side of the input tray for receiving first ultrasonic wave signals emitted by the first emitting element, a first analog-to-digital converter electrically connected with the first receiving element for converting the first ultrasonic wave signals received by the first receiving element into first digital signals, a processor electrically connected with the first emitting element for controlling the first emitting element to be switched on or switched off, a second emitting element, a second receiving element and a second analog-to-digital converter. When the first emitting element is switched on, the first emitting element emits the first ultrasonic wave signals. The processor is electrically connected with the first analog-to-digital converter. The processor reads the first digital signals outputted by the first analog-to-digital converter and compares the first digital signals with a first critical value stored in the processor. The second emitting element is located above a front end of the input tray and is electrically connected with the processor that controls the second emitting element to be switched on or switched off. When the second emitting element is switched on, the second emitting element emits second ultrasonic wave signals frontward and downward towards a top surface of an uppermost piece of the paper. The second receiving element is located above the front end of the input tray for receiving the second ultrasonic wave signals emitted by the second emitting element and reflected by the uppermost piece of the paper. The second analog-to-digital converter is electrically connected with the second receiving element and is electrically connected with the processor for converting the second ultrasonic wave signals reflected by the uppermost piece of the paper into second digital signals and outputting the second digital signals to the processor. The processor reads the second digital signals outputted by the second analog-to-digital converter and compares the second digital signals with a second critical value stored in the processor.

As described above, when a leading end of the uppermost piece of the paper incurs a warping deformation, the uppermost piece of the paper is judged to be warped at the time of the uppermost piece of the paper being fed in, and in addition, when the tail ends of the plurality of pieces of the paper are warped upward to a certain extent, the plurality of pieces of the paper are capable of being detected to be warped, the uppermost piece of the paper is stopped being fed in. As a result, the paper warping detection device applying the paper warping detection method is capable of effectively detecting whether the plurality of pieces of the paper are warped or not at the time of the uppermost piece of the paper being fed in, so that the plurality of pieces of the paper are effectively prevented from being damaged at the time of the uppermost piece of the paper being fed in.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
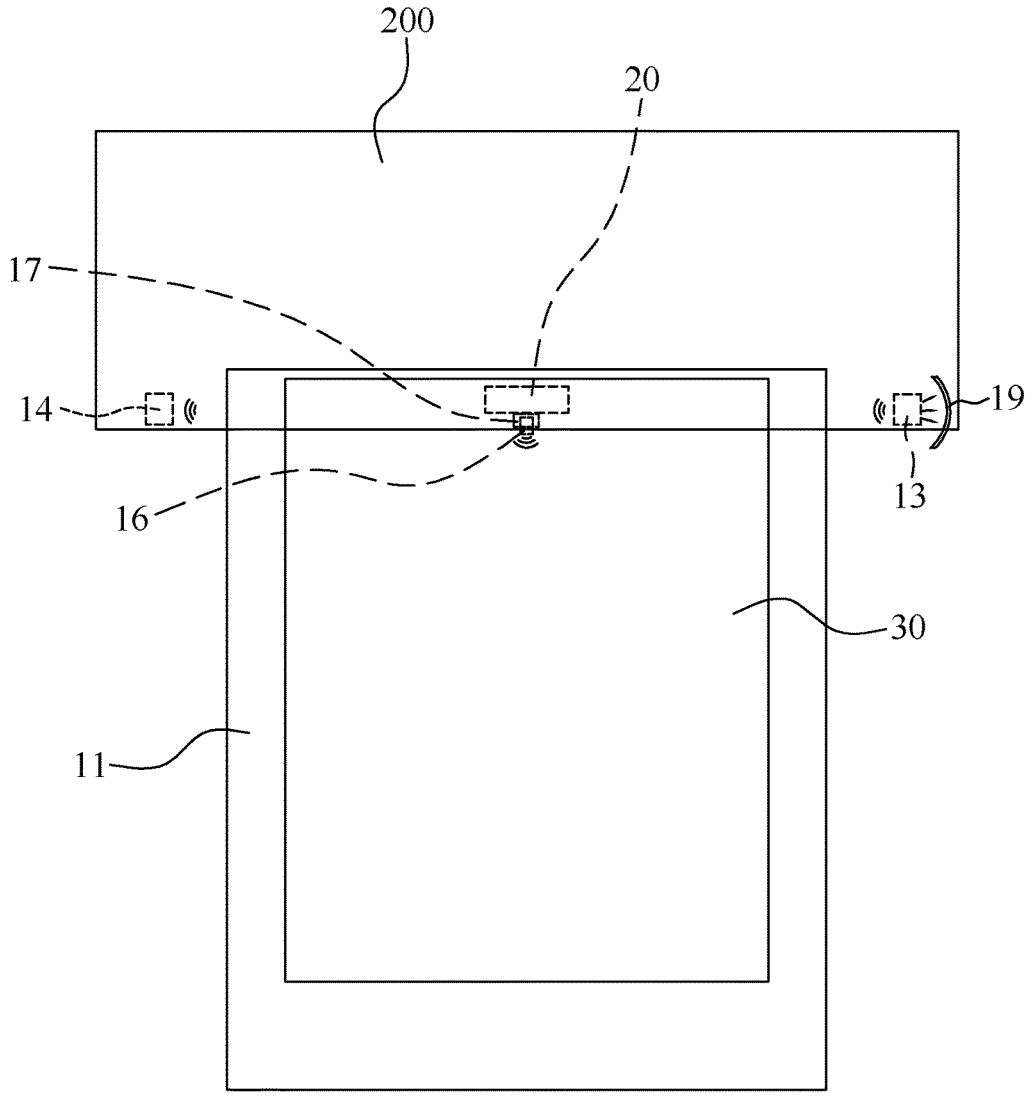
FIG. 1 is a top view of a paper warping detection device in accordance with a preferred embodiment of the present invention.
Figure 2:
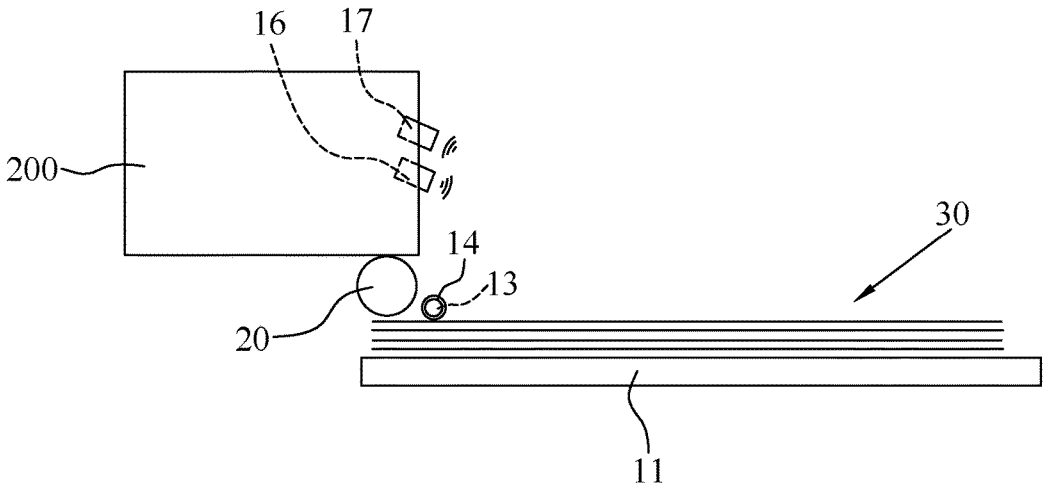
FIG. 2 is a right view of the paper warping detection device of FIG. 1.
Figure 3:
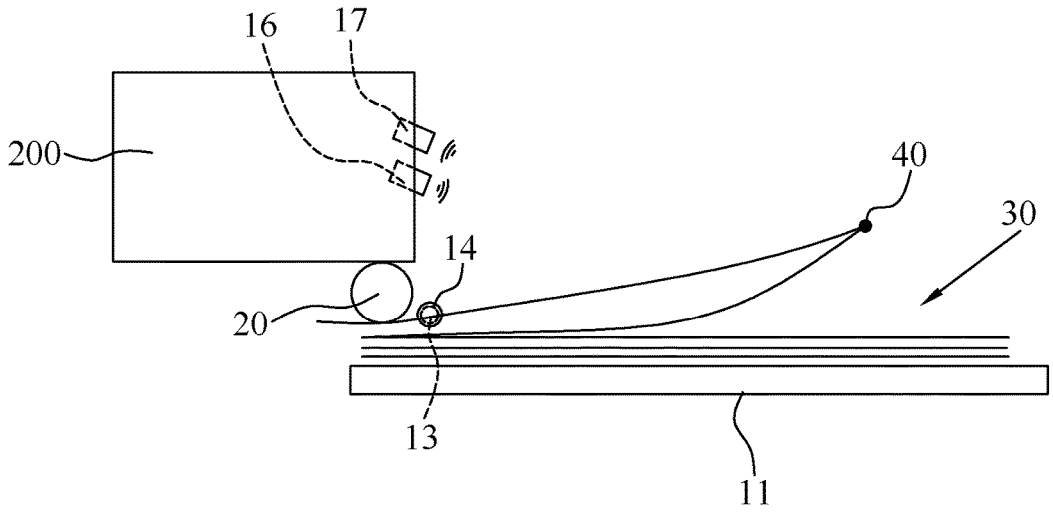
FIG. 3 is a diagrammatic drawing of an abnormal paper feeding status of the paper warping detection device of FIG. 2, wherein a pickup roller of the paper warping detection device picks up an uppermost piece of paper and drives the uppermost piece of the paper to be fed forward, a tail end of the uppermost piece of the paper drives tail ends of the other pieces of the paper stabled with the uppermost piece of the paper to be warped together.
Figure 4:
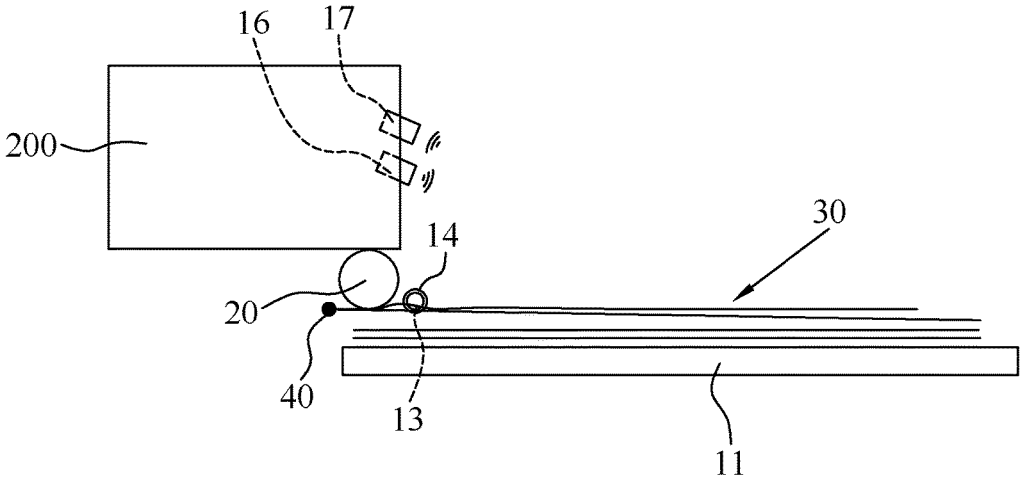
FIG. 4 is a diagrammatic drawing of the abnormal paper feeding status of the paper warping detection device of FIG. 2, wherein leading ends of the plurality of pieces of the paper occur warping deformations after the pickup roller picks up the uppermost piece of the paper.
Figure 5:
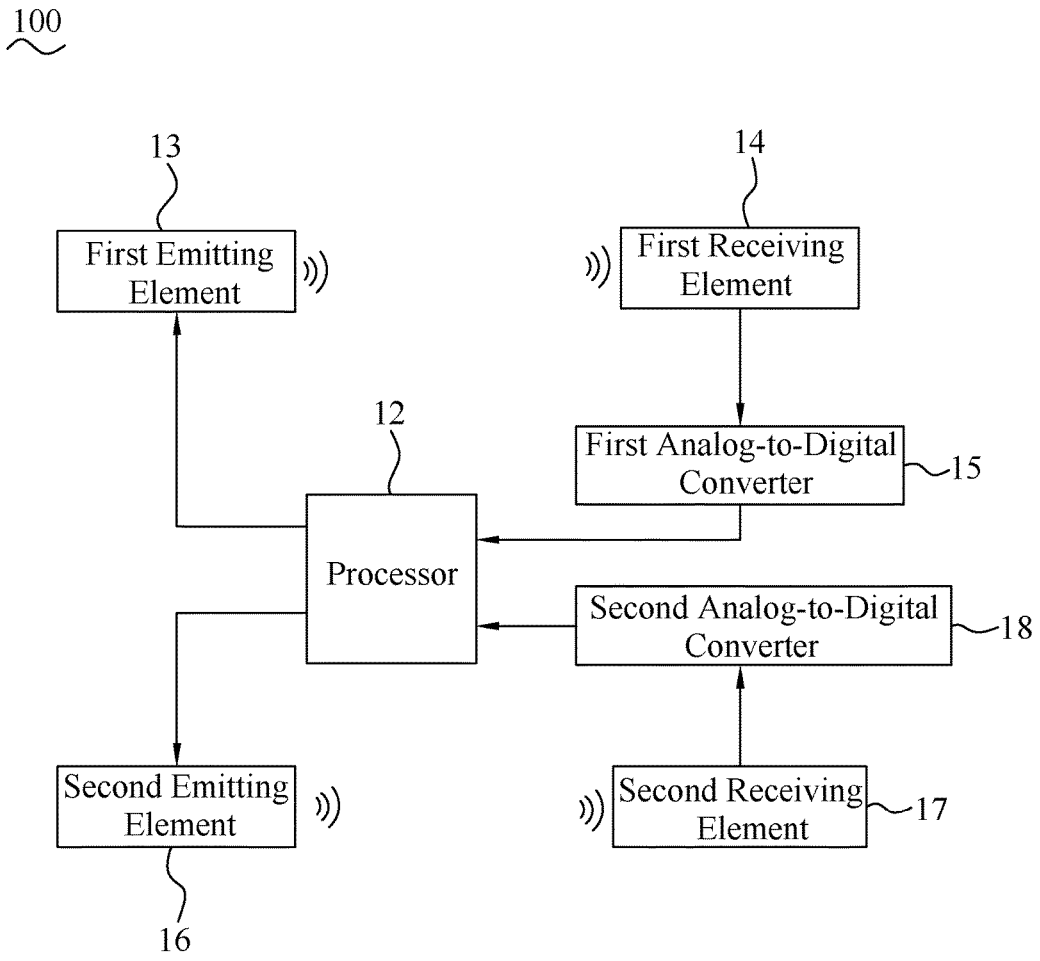
FIG. 5 is a block diagram of the paper warping detection device in accordance with the present invention.
Figure 6:
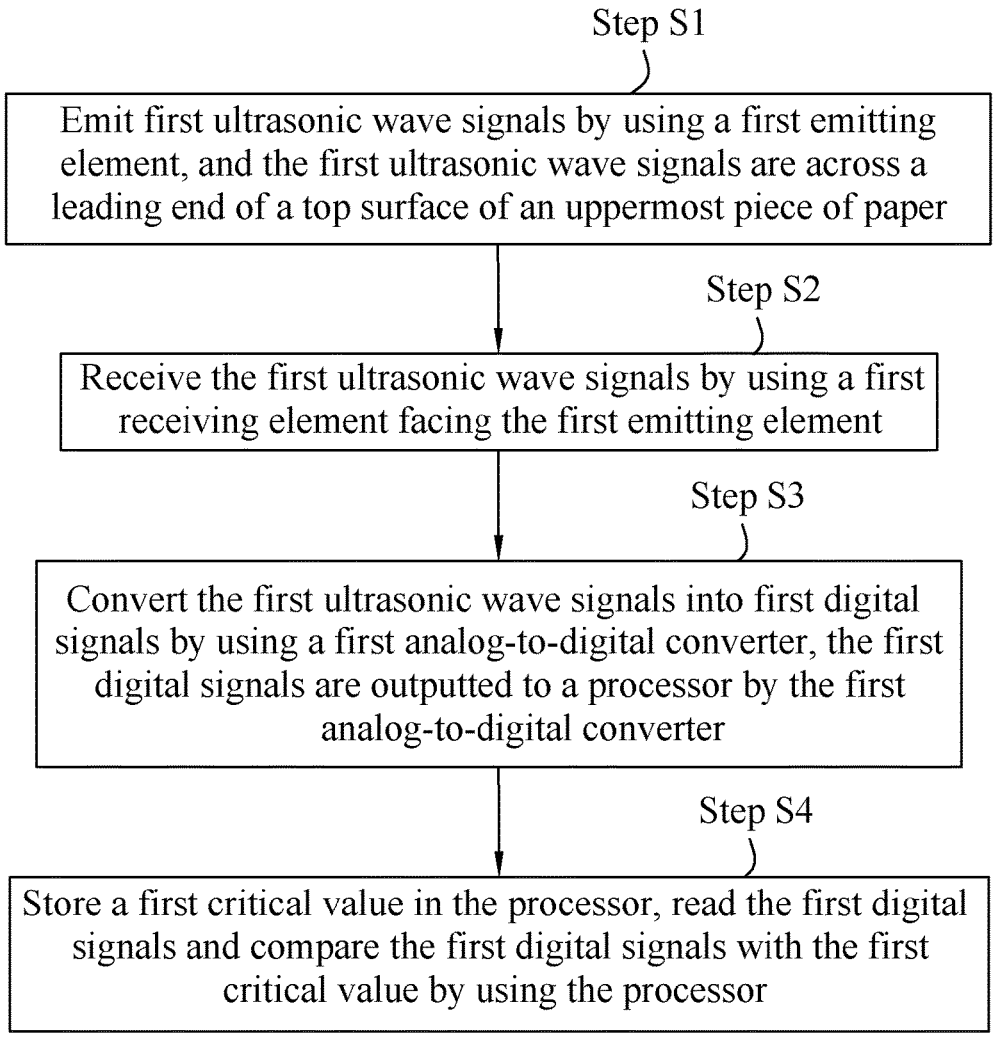
FIG. 6 is a flow diagram of a paper warping detection method applied in the paper warping detection device in accordance with the present invention.
Figure 7:
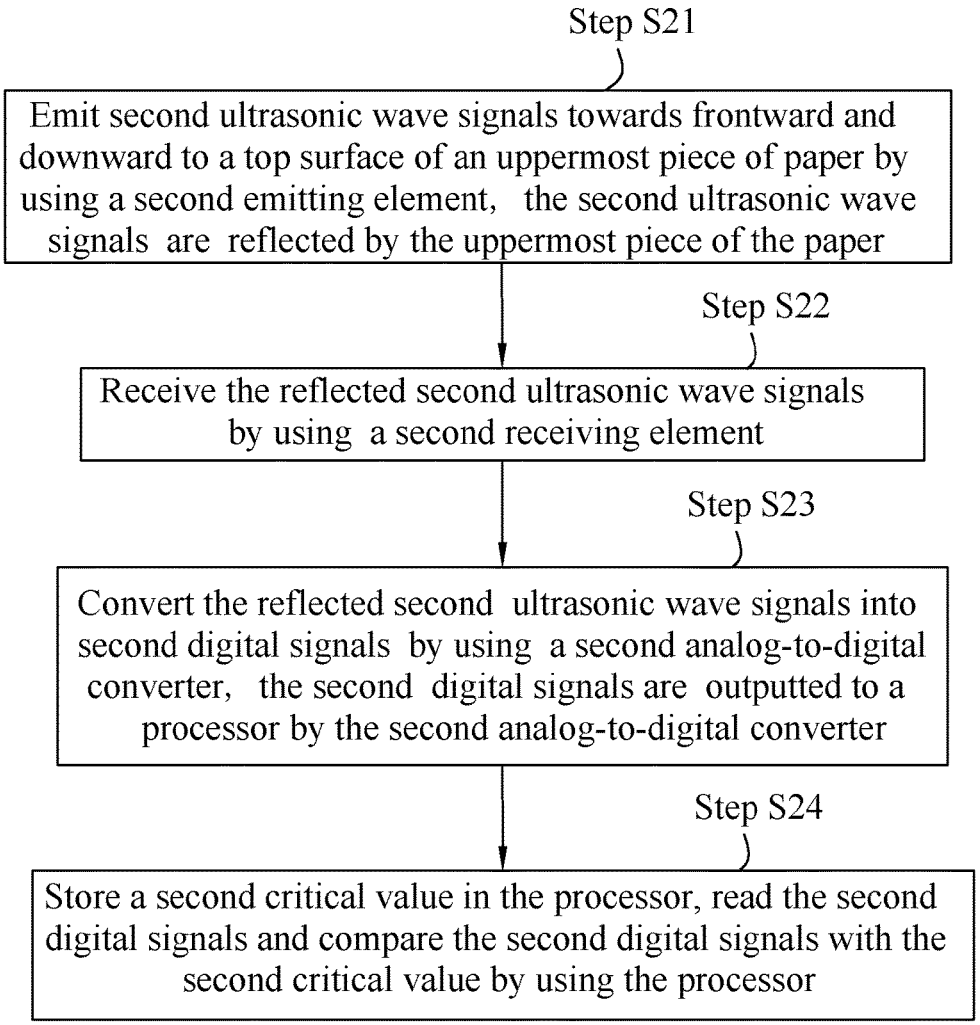
FIG. 7 is another flow diagram of the paper warping detection method applied in the paper warping detection device in accordance with the present invention.

With reference to FIG. 1, FIG. 2 and FIG. 5, a paper warping detection device 100 in accordance with the present invention is shown. The paper warping detection device 100 is assembled in a transaction device 200. The transaction device 200 is a printer or a scanner etc. The paper warping detection device 100 applying a paper warping detection method, includes an input tray 11, a processor 12, a first emitting element 13, a first receiving element 14, a first analog-to-digital converter 15, a second emitting element 16, a second receiving element 17, a second analog-to-digital converter 18, a reflecting barrier 19 and a pickup roller 20.

The input tray 11 is used for loading a plurality of pieces of paper 30 to be fed thereon. The plurality of pieces of the paper 30 to be fed is placed on the input tray 11, and is stacked up and down. A first critical value is stored in the processor 12. The first emitting element 13 is disposed to one lateral side of the input tray 11. The first receiving element 14 is disposed to the other lateral side of the input tray 11 for receiving first ultrasonic wave signals emitted by the first emitting element 13. The first emitting element 13 and the first receiving element 14 are arranged in a transverse direction perpendicular to a direction of feeding each piece of the paper 30 into the transaction device 200. The first emitting element 13 is electrically connected with the processor 12. The processor 12 controls the first emitting element 13 to be switched on or switched off. When the first emitting element 13 is switched on, the first emitting element 13 emits the first ultrasonic wave signals towards the first receiving element 14 and across a top surface of an uppermost piece of the paper 30. So the first receiving element 14 receives the first ultrasonic wave signals emitted by the first emitting element 13. The first receiving element 14 and the first emitting element 13 face each other. The first analog-to-digital converter 15 is electrically connected with the first receiving element 14 and is electrically connected with the processor 12 for converting the first ultrasonic wave signals received by the first receiving element 14 into first digital signals and outputting the first digital signals to the processor 12. The processor 12 reads the first digital signals outputted by the first analog-to-digital converter 15 and compares the first digital signals with the first critical value. Specifically, the first analog-to-digital converter 15 is connected between the first receiving element 14 and the processor 12.

The reflecting barrier 19 is disposed to an outer side of the first emitting element 13 away from the input tray 11. An inner surface of the reflecting barrier 19 facing the first emitting element 13 is arched outward away from the first emitting element 13 to show an arc shape. The arc-shaped inner surface of the reflecting barrier 19 faces the first receiving element 14. The first emitting element 13 emits the first ultrasonic wave signals towards the reflecting barrier 19. The first ultrasonic wave signals are reflected by the reflecting barrier 19. The first receiving element 14 receives the reflected first ultrasonic wave signals. The reflected first ultrasonic wave signals are capable of being made to be more concentrated and uneasily diffused by virtue of the paper warping detection device 100 being equipped with the reflecting barrier 19. A leading end of each piece of the paper 30 is defined as a feeding end of each piece of the paper 30. A tail end of each piece of the paper 30 is opposite to the feeding end of each piece of the paper 30. The transaction device 200 has the pickup roller 20 located above the input tray 11 and disposed to the leading ends of the plurality of pieces of the paper 30. The input tray 11 is capable of moving upward and downward with respect to the pickup roller 20. The first emitting element 13 and the first receiving element 14 are located to the leading ends of the plurality of pieces of the paper 30, and are both positioned on one side of the pickup roller 20 so that the first ultrasonic wave signals are not obstructed by the pickup roller 20.

A second critical value is stored in the processor 12. The second emitting element 16 is located above a front end of the input tray 11 and is electrically connected with the processor 12. The processor 12 controls the second emitting element 16 to be switched on or switched off. When the second emitting element 16 is switched on, the second emitting element 16 emits second ultrasonic wave signals towards frontward and downward to a top surface of the uppermost piece of the paper 30. The second receiving element 17 is located above the front end of the input tray 11 for receiving the second ultrasonic wave signals emitted by the second emitting element 16 and reflected by the uppermost piece of the paper 30. The second analog-to-digital converter 18 is electrically connected with the second receiving element 17 and is electrically connected with the processor 12 for converting the second ultrasonic wave signals reflected by the uppermost piece of the paper 30 and received by the second receiving element 17 into second digital signals and outputting the second digital signals to the processor 12. The processor 12 reads the second digital signals outputted by the second analog-to-digital converter 18 and compares the second digital signals with the second critical value stored in the processor 12.

With reference to FIG. 1 to FIG. 6, the paper warping detection method is applied in the paper warping detection device 100. The paper warping detection device 100 applying the paper warping detection method is capable of effectively detecting whether the plurality of pieces of the paper 30 are warped or not at the time of the uppermost piece of the paper 30 being fed in. Specific steps of the paper warping detection method of the paper warping detection device 100 in accordance with the present invention are described as follows.

Step S1: emit the first ultrasonic wave signals by using the first emitting element 13, and the first ultrasonic wave signals are across a leading end of the top surface of the uppermost piece of the paper 30.

Step S2: receive the first ultrasonic wave signals by using the first receiving element 14 facing the first emitting element 13.

Step S3: convert the first ultrasonic wave signals into the first digital signals by using the first analog-to-digital converter 15, the first digital signals are outputted to the processor 12 by the first analog-to-digital converter 15.

Step S4: store the first critical value in the processor 12, read the first digital signals and compare the first digital signals with the first critical value by using the processor 12, when a strength of the first digital signals outputted by the first analog-to-digital converter 15 is less than the first critical value, the paper 30 is judged to be warped at the time of the uppermost piece of the paper 30 being fed in, and the plurality of pieces of the paper 30 are stopped being fed in, and otherwise on the contrary, the paper 30 is judged to be normally fed at the time of the uppermost piece of the paper 30 being fed in.

So that the first emitting element 13 and the first receiving element 14 face each other at the time of the uppermost piece of the paper 30 being judged to be normally fed, and the plurality of pieces of the paper 30 are located between the first emitting element 13 and the first receiving element 14 to obstruct the first ultrasonic wave signals to be emitted from the first emitting element 13 to the first receiving element 14 at the time of the plurality of pieces of the paper 30 being judged to be warped.

With reference to FIG. 1 to FIG. 7, the paper warping detection method applied in the paper warping detection device 100 is still capable of further including following steps.

Step S21: emit the second ultrasonic wave signals towards frontward and downward to the top surface of the uppermost piece of the paper 30 by using the second emitting element 16, the second ultrasonic wave signals are reflected by the uppermost piece of the paper 30.

Step S22: receive the reflected second ultrasonic wave signals by using the second receiving element 17.

Step S23: convert the reflected second ultrasonic wave signals into the second digital signals by using the second analog-to-digital converter 18, the second digital signals are outputted to the processor 12 by the second analog-to-digital converter 18.

Step S24: store the second critical value in the processor 12, read the second digital signals and compare the second digital signals with the second critical value by using the processor 12, when a strength of the second digital signals is greater than the second critical value, the uppermost piece of the paper 30 is judged to be warped at the time of the uppermost piece of the paper 30 being fed in, and the plurality of pieces of the paper 30 are stopped being fed in, and otherwise, the uppermost piece of the paper 30 is judged to be normally fed at the time of the uppermost piece of the paper 30 being fed in.

Referring to FIG. 1 to FIG. 7, a working principle of the paper warping detection device 100 applying the paper warping detection method is described as follows. When the uppermost piece of the paper 30 is picked up, the pickup roller 20 moves downward until the pickup roller 20 abuts against the top surface of the uppermost piece of the paper 30 loaded on the input tray 11. When the pickup roller 20 picks up the uppermost piece of the paper 30 and drives the uppermost piece of the paper 30 to be fed normally, the first receiving element 14 receives the stronger and stabler first ultrasonic wave signals. The leading ends of the plurality of pieces of the paper 30 to be fed are stapled by a staple 40. When the pickup roller 20 rotates and drives the uppermost piece of the paper 30 to be normally fed forward, at the moment, the leading end of the uppermost piece of the paper 30 will incur a warping deformation. A warping portion of the uppermost piece of the paper 30 will obstruct the first ultrasonic wave signals received by the first receiving element 14 and emitted by the first emitting element 13, so that the weaker first ultrasonic wave signals are received by the first receiving element 14 or the first ultrasonic wave signals are without being received by the first receiving element 14. When the strength of the first ultrasonic wave signals received by the first receiving element 14 is less than the first critical value, namely the uppermost piece of the paper 30 is judged to be warped at the time of the uppermost piece of the paper 30 being fed in, the plurality of pieces of the paper 30 are stopped being fed in, so that the plurality of pieces of the paper 30 are effectively prevented from being damaged at the time of the uppermost piece of the paper 30 being fed in.

Tail ends of the plurality of pieces of the paper 30 are stapled by another staple 40, when the pickup roller 20 picks up the uppermost piece of the paper 30, and the pickup roller 20 drives the uppermost piece of the paper 30 to be fed forward, a tail end of the uppermost piece of the paper 30 will drive tail ends of the other pieces of the paper 30 stapled with the uppermost piece of the paper 30 to be warped together. When the tail ends of the plurality of pieces of the paper 30 are warped upward to a certain extent, the leading end of the uppermost piece of the paper 30 will be warped to obstruct the first ultrasonic wave signals received by the first receiving element 14 and emitted by the first emitting element 13. More, seriously, the leading ends of the other pieces of the paper 30 will be warped to obstruct the first ultrasonic wave signals received by the first receiving element 14 and emitted by the first emitting element 13, and in this case, the plurality of pieces of the paper 30 are capable of being detected to be warped by means of the step S1 to the step S4 of the paper warping detection method. Nevertheless, strain velocities of the first receiving element 14 and the first emitting element 13 in this case are slow (only when the tail ends of the plurality of pieces of the paper 30 are warped to the certain extent, can the leading end of the uppermost piece of the paper 30 be warped and deformed to obstruct the first ultrasonic wave signals received by the first receiving element 14 and emitted by the first emitting element 13; more seriously, only when the tail ends of the plurality of pieces of the paper 30 are warped to the certain extent, can the leading ends of the other pieces of the paper 30 be warped and deformed to obstruct the first ultrasonic wave signals received by the first receiving element 14 and emitted by the first emitting element 13, and only in this way can the plurality of pieces of the paper 30 be detected to be warped at the time of the uppermost piece of the paper 30 being fed in), at the moment, the tail ends of the plurality pieces of the paper 30 are even warped to the leading ends of the plurality of pieces of the paper 30, and the plurality of pieces of the paper 30 are apt to be damaged. Thus, in that condition, the plurality of pieces of the paper 30 are capable of being preferably detected to be warped by virtue of the step S1, the step S2, the step S3, the step S4, the step S21, the step S22, the step S23 and the step S24 of the paper warping detection method being cooperated with one another, the uppermost piece of the paper 30 is stopped being fed in, the plurality of pieces of the paper 30 are more effectively prevented from being damaged at the time of the uppermost piece of the paper 30 being fed in.

When the step S1, the step S2, the step S3, the step S4, the step S21, the step S22, the step S23 and the step S24 of the paper warping detection method are cooperated with one another, a working principle of the paper warping detection device 100 applying the paper warping detection method is described as follows. When the uppermost piece of the paper 30 is fed normally, the second receiving element 17 is incapable of receiving the second ultrasonic wave signals or the second receiving element 17 is only capable of receiving the weaker second ultrasonic wave signals (the second emitting element 16 and the second receiving element 17 are both located above the front end of the input tray 11, namely the second emitting element 16 and the second receiving element 17 are located at a same side). The tail ends of the plurality of pieces of the paper 30 are stapled by the staple 40, when the pickup roller 20 picks up the uppermost piece of the paper 30, and the pickup roller 20 drives the uppermost piece of the paper 30 to be fed forward, the tail end of the uppermost piece of the paper 30 will drive the tail ends of the other pieces of the paper 30 stapled with the uppermost piece of the paper 30 to be warped together. The second ultrasonic wave signals emitted by the second emitting element 16 will be made to be reflected by virtue of the plurality pieces of the paper 30 being warped, so that the second receiving element 17 is capable of receiving the stronger second ultrasonic wave signals, when the strength of the second ultrasonic wave signals received by the second receiving element 17 is greater than the second critical value, namely the uppermost piece of the paper 30 is judged to be warped at the time of the uppermost piece of the paper 30 being fed in, more seriously, the other pieces of the paper 30 are judged to be warped at the time of the uppermost piece of the paper 30 being fed in, the uppermost piece of the paper 30 is stopped being fed in, so that the plurality of pieces of the paper 30 are effectively prevented from being damaged at the time of the uppermost piece of the paper 30 being fed in. The second receiving element 17 is almost capable of receiving all the reflected second ultrasonic wave signals on account of diffraction characteristics, larger receiving angles and larger emitting angles of the reflected second ultrasonic wave signals. The paper warping detection method just need choose the first emitting element 13 and first receiving element 14, the second emitting element 16 and the second receiving element 17 or the first emitting element 13, the first receiving element 14, the second emitting element 16 and the second receiving element 17 to realize detecting whether the plurality of pieces of the paper 30 are warped or not, so a cost of the paper warping detection device 100 applying the paper warping detection method and calibration programs of the paper warping detection method are saved.

As described above, when the leading end of the uppermost piece of the paper 30 occurs the warping deformation, the uppermost piece of the paper 30 is judged to be warped at the time of the uppermost piece of the paper 30 being fed in, and in addition, when the tail ends of the plurality of pieces of the paper 30 are warped upward to the certain extent, the plurality of pieces of the paper 30 are capable of being detected to be warped, the uppermost piece of the paper 30 is stopped being fed in. As a result, the paper warping detection device 100 applying the paper warping detection method is capable of effectively detecting whether the plurality of pieces of the paper 30 are warped or not at the time of the uppermost piece of the paper 30 being fed in, so that the plurality of pieces of the paper 30 are effectively prevented from being damaged at the time of the uppermost piece of the paper 30 being fed in.

What is claimed is:

1. A paper warping detection device, comprising:

an input tray for loading a plurality of pieces of paper to be fed;

a processor, a first critical value being stored in the processor;

a first emitting element disposed to one side of the input tray, the first emitting element being electrically connected with the processor, the processor controlling the first emitting element to be switched on or switched off;

a first receiving element disposed to the other side of the input tray, the first receiving element and the first emitting element facing each other, when the first emitting element is switched on, the first emitting element emitting first ultrasonic wave signals towards the first receiving element, and the first receiving element receiving the first ultrasonic wave signals emitted by the first emitting element;

a first analog-to-digital converter electrically connected with the first receiving element and being electrically connected with the processor for converting the first ultrasonic wave signals received by the first receiving element into first digital signals and outputting the first digital signals to the processor, the processor reading the first digital signals outputted by the first analog-to-digital converter and comparing the first digital signals with the first critical value; and a reflecting barrier disposed to an outer side of the first emitting element away from the input tray, an inner surface of the reflecting barrier facing the first emitting element being arched outward away from the first emitting element to show an arc shape, the arc-shaped inner surface of the reflecting barrier facing the first receiving element, the first emitting element emitting the first ultrasonic wave signals towards the reflecting barrier, the first ultrasonic wave signals being reflected by the reflecting barrier, and the first receiving element receiving the reflected first ultrasonic wave signals.

2. The paper warping detection device as claimed in claim 1, further comprising a second emitting element, a second receiving element and a second analog-to-digital converter, the second emitting element being located above a front end of the input tray and electrically connected with the processor, the processor controlling the second emitting element to be switched on or switched off, when the second emitting element is switched on, the second emitting element emitting second ultrasonic wave signals frontward and downward towards a top surface of an uppermost piece of the paper, the second receiving element being located above the front end of the input tray for receiving the second ultrasonic wave signals emitted by the second emitting element and reflected by the uppermost piece of the paper, the second analog-to-digital converter being electrically connected with the second receiving element and electrically connected with the processor for converting the second ultrasonic wave signals reflected by the uppermost piece of the paper into second digital signals and outputting the second digital signals to the processor, and the processor reading the second digital signals outputted by the second analog-to-digital converter and comparing the second digital signals with a second critical value stored in the processor.

3. The paper warping detection device as claimed in claim 1, further comprising a pickup roller located above the input tray and disposed to leading ends of the plurality of pieces of the paper, the input tray is capable of moving upward and downward with respect to the pickup roller, so that the first emitting element and the first receiving element face each other at the time of an uppermost piece of the paper being judged to be normally fed, and the plurality of pieces of the paper are located between the first emitting element and the first receiving element to obstruct the first ultrasonic wave signals to be emitted from the first emitting element to the first receiving element at the time of the plurality of pieces of the paper being judged to be warped.

4. The paper warping detection device as claimed in claim 3, wherein the first emitting element and the first receiving element are located to the leading ends of the plurality pieces of the paper and positioned on one side of the pickup roller so that the first ultrasonic wave signals are not obstructed by the pickup roller.

5. The paper warping detection device as claimed in claim 1, wherein the first emitting element and the first receiving element are arranged in a transverse direction perpendicular to a direction of feeding each piece of the paper into a transaction device in which the paper warping detection device is assembled.

6. A paper warping detection method applied in a paper warping detection device, comprising steps of:

emitting first ultrasonic wave signals by using a first emitting element, and the first ultrasonic wave signals being across a leading end of a top surface of an uppermost piece of paper;

receiving the first ultrasonic wave signals by using a first receiving element facing the first emitting element;

converting the first ultrasonic wave signals into first digital signals by using a first analog-to-digital converter, the first digital signals being outputted to a processor by the first analog-to-digital converter;

storing a first critical value in the processor, reading the first digital signals and comparing the first digital signals with the first critical value by using the processor, when a strength of the first digital signals outputted by the first analog-to-digital converter is less than the first critical value, the paper being judged to be warped at the time of the uppermost piece of the paper being fed in, and the paper being stopped, and otherwise the paper being judged to be normally fed at the time of the uppermost piece of the paper being fed in;

emitting second ultrasonic wave signals frontward and downward towards the top surface of the uppermost piece of the paper by using a second emitting element, the second ultrasonic wave signals being reflected by the uppermost piece of the paper;

receiving the reflected second ultrasonic wave signals by using a second receiving element;

converting the reflected second ultrasonic wave signals into second digital signals by using a second analog-to-digital converter, the second digital signals being outputted to the processor by the second analog-to-digital converter; and storing a second critical value in the processor, reading the second digital signals and comparing the second digital signals with the second critical value by using the processor, when a strength of the second digital signals is greater than the second critical value, the uppermost piece of the paper being judged to be warped at the time of the uppermost piece of the paper being fed in and the plurality of pieces of the paper being, and otherwise the uppermost piece of the paper being judged to be normally fed at the time of the uppermost piece of the paper being fed in.

7. A paper warping detection device assembled in a transaction device, comprising:

an input tray for loading a plurality of pieces of paper;

a first emitting element disposed to one lateral side of the input tray;

a first receiving element disposed to the other lateral side of the input tray for receiving first ultrasonic wave signals emitted by the first emitting element;

a first analog-to-digital converter electrically connected with the first receiving element for converting the first ultrasonic wave signals received by the first receiving element into first digital signals;

a processor electrically connected with the first emitting element for controlling the first emitting element to be switched on or switched off, when the first emitting element is switched on, the first emitting element emitting the first ultrasonic wave signals, the processor being electrically connected with the first analog-to-digital converter, the processor reading the first digital signals outputted by the first analog-to-digital converter and comparing the first digital signals with a first critical value stored in the processor; and a reflecting barrier disposed to an outer side of the first emitting element away from the input tray, an inner surface of the reflecting barrier facing the first emitting element being arched outward away from the first emitting element to show an arc shape, the arc-shaped inner surface of the reflecting barrier facing the first receiving element, the first emitting element emitting the first ultrasonic wave signals towards the reflecting barrier, the first ultrasonic wave signals being reflected by the reflecting barrier, and the first receiving element receiving the reflected first ultrasonic wave signals.

8. The paper warping detection device as claimed in claim 7, further comprising a second emitting element, a second receiving element and a second analog-to-digital converter, the second emitting element being located above a front end of the input tray and electrically connected with the processor, the processor controlling the second emitting element to be switched on or switched off, when the second emitting element is switched on, the second emitting element emitting second ultrasonic wave signals frontward and downward towards a top surface of an uppermost piece of the paper, the second receiving element being located above the front end of the input tray for receiving the second ultrasonic wave signals emitted by the second emitting element and reflected by the uppermost piece of the paper, the second analog-to-digital converter being electrically connected with the second receiving element and being electrically connected with the processor for converting the second ultrasonic wave signals reflected by the uppermost piece of the paper into second digital signals and outputting the second digital signals to the processor, and the processor reading the second digital signals outputted by the second analog-to-digital converter and comparing the second digital signals with a second critical value stored in the processor.

9. The paper warping detection device as claimed in claim 7, wherein the transaction device has a pickup roller located above the input tray and disposed to leading ends of the plurality of pieces of the paper, the input tray is capable of moving upward and downward with respect to the pickup roller, so that the first emitting element and the first receiving element face each other at the time of an uppermost piece of the paper being judged to be normally fed, and the plurality of pieces of the paper are located between the first emitting element and the first receiving element to obstruct the first ultrasonic wave signals to be emitted from the first emitting element to the first receiving element at the time of the plurality of pieces of the paper being judged to be warped.

10. The paper warping detection device as claimed in claim 9, wherein the first emitting element and the first receiving element are located to the leading ends of the plurality of pieces of the paper and positioned on one side of the pickup roller so that the first ultrasonic wave signals are not obstructed by the pickup roller.

11. A paper warping detection device, comprising:

an input tray for loading a plurality of pieces of paper to be fed;

a processor, a first critical value being stored in the processor;

a first emitting element disposed to one side of the input tray, the first emitting element being electrically connected with the processor, the processor controlling the first emitting element to be switched on or switched off;

a first receiving element disposed to the other side of the input tray, the first receiving element and the first emitting element facing each other, when the first emitting element is switched on, the first emitting element emitting first ultrasonic wave signals towards the first receiving element, and the first receiving element receiving the first ultrasonic wave signals emitted by the first emitting element;

a first analog-to-digital converter electrically connected with the first receiving element and being electrically connected with the processor for converting the first ultrasonic wave signals received by the first receiving element into first digital signals and outputting the first digital signals to the processor, the processor reading the first digital signals outputted by the first analog-to-digital converter and comparing the first digital signals with the first critical value;

a second emitting element located above a front end of the input tray and electrically connected with the processor, the processor controlling the second emitting element to be switched on or switched off, when the second emitting element is switched on, the second emitting element emitting second ultrasonic wave signals frontward and downward towards a top surface of an uppermost piece of the paper;

a second receiving element located above the front end of the input tray for receiving the second ultrasonic wave signals emitted by the second emitting element and reflected by the uppermost piece of the paper; and a second analog-to-digital converter electrically connected with the second receiving element and the processor for converting the second ultrasonic wave signals reflected by the uppermost piece of the paper into second digital signals and outputting the second digital signals to the processor, and the processor reading the second digital signals outputted by the second analog-to-digital converter and comparing the second digital signals with a second critical value stored in the processor.

12. The paper warping detection device as claimed in claim 11, further comprising a pickup roller located above the input tray and disposed to leading ends of the plurality of pieces of the paper, the input tray is capable of moving upward and downward with respect to the pickup roller, so that the first emitting element and the first receiving element face each other at the time of an uppermost piece of the paper being judged to be normally fed, and the plurality of pieces of the paper are located between the first emitting element and the first receiving element to obstruct the first ultrasonic wave signals to be emitted from the first emitting element to the first receiving element at the time of the plurality of pieces of the paper being judged to be warped.

13. The paper warping detection device as claimed in claim 12, wherein the first emitting element and the first receiving element are located to the leading ends of the plurality pieces of the paper and positioned on one side of the pickup roller so that the first ultrasonic wave signals are not obstructed by the pickup roller.

14. The paper warping detection device as claimed in claim 11, wherein the first emitting element and the first receiving element are arranged in a transverse direction perpendicular to a direction of feeding each piece of the paper into a transaction device in which the paper warping detection device is assembled.

15. A paper warping detection device assembled in a transaction device, comprising:

an input tray for loading a plurality of pieces of paper;

a first emitting element disposed to one lateral side of the input tray;

a first receiving element disposed to the other lateral side of the input tray for receiving first ultrasonic wave signals emitted by the first emitting element;

a first analog-to-digital converter electrically connected with the first receiving element for converting the first ultrasonic wave signals received by the first receiving element into first digital signals;

a processor electrically connected with the first emitting element for controlling the first emitting element to be switched on or switched off, when the first emitting element is switched on, the first emitting element emitting the first ultrasonic wave signals, the processor being electrically connected with the first analog-to-digital converter, the processor reading the first digital signals outputted by the first analog-to-digital converter and comparing the first digital signals with a first critical value stored in the processor;

a second emitting element located above a front end of the input tray and electrically connected with the processor, the processor controlling the second emitting element to be switched on or switched off, when the second emitting element is switched on, the second emitting element emitting second ultrasonic wave signals frontward and downward towards a top surface of an uppermost piece of the paper;

a second receiving element located above the front end of the input tray for receiving the second ultrasonic wave signals emitted by the second emitting element and reflected by the uppermost piece of the paper; and a second analog-to-digital converter electrically connected with the second receiving element and the processor for converting the second ultrasonic wave signals reflected by the uppermost piece of the paper into second digital signals and outputting the second digital signals to the processor, and the processor reading the second digital signals outputted by the second analog-to-digital converter and comparing the second digital signals with a second critical value stored in the processor.

16. The paper warping detection device as claimed in claim 15, further comprising a pickup roller located above the input tray and disposed to leading ends of the plurality of pieces of the paper, the input tray is capable of moving upward and downward with respect to the pickup roller, so that the first emitting element and the first receiving element face each other at the time of an uppermost piece of the paper being judged to be normally fed, and the plurality of pieces of the paper are located between the first emitting element and the first receiving element to obstruct the first ultrasonic wave signals to be emitted from the first emitting element to the first receiving element at the time of the plurality of pieces of the paper being judged to be warped.

17. The paper warping detection device as claimed in claim 16, wherein the first emitting element and the first receiving element are located to the leading ends of the plurality pieces of the paper and positioned on one side of the pickup roller so that the first ultrasonic wave signals are not obstructed by the pickup roller.

18. The paper warping detection device as claimed in claim 15, wherein the first emitting element and the first receiving element are arranged in a transverse direction perpendicular to a direction of feeding each piece of the paper into the transaction device.

* * * * *